US005509585A

United States Patent [19]

Mock et al.

[11] Patent Number: 5,509,585

[45] Date of Patent: Apr. 23, 1996

[54] CLOSURE UNIT

[75] Inventors: Elmar Mock, Biel; Marcel Aeschlimann, Welschenrohr, both of Switzerland

[73] Assignee: Tetra Laval Holdings & Finance S.A., Pully, Switzerland

[21] Appl. No.: 182,106

[22] PCT Filed: May 19, 1993

[86] PCT No.: PCT/CH93/00128

§ 371 Date: Jan. 18, 1994

§ 102(e) Date: Jan. 18, 1994

[87] PCT Pub. No.: WO93/24376

PCT Pub. Date: Dec. 9, 1993

[30] Foreign Application Priority Data

Jan. 6, 1992 [CH] Switzerland ..... 01 754/92

[51] Int. Cl.[6] ..... B67B 5/00

[52] U.S. Cl. ..... 222/541.1; 222/566; 222/556; 215/341; 215/DIG. 2; 229/125.15

[58] Field of Search ..... 215/341, DIG. 2; 229/125.15; 222/556, 566, 572, 541.1

[56] References Cited

U.S. PATENT DOCUMENTS

| | | | |
|---|---|---|---|
| 3,666,138 | 5/1972 | Morris, Jr. et al. | 222/485 X |
| 4,021,524 | 5/1977 | Grimsley | 264/242 |
| 4,362,255 | 12/1982 | Bond | 222/107 |
| 4,512,486 | 4/1985 | Kobayashi et al. | 215/249 |
| 4,669,640 | 6/1987 | Ando et al. | 222/556 X |
| 4,792,069 | 12/1988 | Nantin et al. | 229/125.15 X |
| 4,795,065 | 1/1989 | Ashizawa et al. | 222/556 X |
| 4,798,296 | 1/1989 | Lagerstedt et al. | 229/125.15 X |
| 4,948,015 | 8/1990 | Kawajiri et al. | 222/107 |
| 5,027,979 | 7/1991 | Kawajiri et al. | 222/83 |
| 5,069,372 | 12/1991 | Kawajiri et al. | 222/541 |
| 5,108,029 | 4/1992 | Abrams et al. | 229/125.15 X |
| 5,372,284 | 12/1994 | Mock | 222/556 X |
| 5,381,935 | 1/1995 | Mock | 222/556 X |

FOREIGN PATENT DOCUMENTS

| | | |
|---|---|---|
| 0079676 | 5/1983 | European Pat. Off. . |
| 2320870 | 3/1977 | France . |
| 454264 | 4/1988 | Sweden . |
| 2241225 | 8/1991 | United Kingdom . |

OTHER PUBLICATIONS

Database WPI, Section PQ, Week 8818, Derwent Publications Ltd., London, England, Abstract of Swedish patent document 454264 (Tetra Pak Int. AB), 18 Apr. 1988.

*Primary Examiner*—Andres Kashnikow
*Assistant Examiner*—Kenneth Bomberg
*Attorney, Agent, or Firm*—Walter C. Farley

[57] ABSTRACT

In a thermoplastic closure unit for a container (1) for the handling and storage of flowable products comprising a substantially tubular pouring part (3) and a closure part (5) sealing the opening of the pouring part, a coating (12,19) is applied to the pouring part and the closure part for protecting the product. Such coatings can be applied to the inside, to the outside or to both sides and can e.g. be provided for protecting the product against the action of oxygen.

10 Claims, 2 Drawing Sheets

CLOSURE UNIT

FIELD OF THE INVENTION

The invention is in the field of the packaging industry and relates to a closure unit and to a process for its production having a substantially tubular pouring part and a closure part.

BACKGROUND OF THE INVENTION

On containers for liquids, such as e.g. metal cans or receptacles made from coated or laminated cardboard, for the purpose of a resealable opening and for easy pouring, use is often made of closure units, preferably made from plastic and comprising a pouring part with a pouring opening and a closure part closing the pouring opening of the pouring part and fitted into an opening of the container. Such a closure unit is e.g. disclosed by Swiss patent application 2740/91, which corresponds to U.S. Ser. No. 08/050,477.

Such closure units are made from plastic, which is inexpensive and has favorable characteristics for the manufacture of the closure unit. It enables manufacture to take place with tools so as to permit a considerable output. The aim is that the closure unit only insignificantly increases the container price and consequently the container with the closure unit appears attractive to the user from a maximum number of standpoints. However, it can occur that the product in the container has to be given additional protection against influences from the environment, so that it can be kept longer. Such influences which can unfavourably influence the product are e.g. environmental moisture and air, together with light or radiation of other types. It is also possible for gases, such as waste gases, which are mixed with the environmental air, to unfavorably influence foods in such containers and oxidize the vitamins contained therein or modify the taste of such foods. Therefore it can be desirable to provide such containers with coatings, which do not permit the passage of gases and/or light.

The closure unit must also satisfy the requirements generally made on the container. In this sense the procedure has hitherto been such that either the opening in the container or the opening in the closure unit is covered with a foil or film, which must be destroyed at the time of the initial pouring out or removal of the product.

The disadvantage of this solution is that said film or foil, has to be removed or perforated at the time of the initial pouring out and that it subsequently can no longer fulfil its intended function, i.e. it is for example no longer gas-tight or is no longer impervious to light. It can also no longer fulfil its function if a closure part of the closure unit again firmly closes the pouring opening, because on closing the closure part the film or foil is not restored to its original state. Therefore, the container as a whole, has lost part of its characteristics as a result of the initial opening of the closure unit in the same way as for a container not having a closure unit and is also accepted, because it would appear to be unavoidable.

SUMMARY OF THE INVENTION

The invention solves the problem of providing a closure unit for a container, with which the original characteristics of the container and which are essential for protecting the product, remain substantially unchanged even after the closure unit has been opened several times. In particular, the invention solves the problem of providing a closure unit for a container, which also in the closed state is substantially gas-tight and/or radiation-impermeable, even if the closure has already been opened.

According to the invention this is achieved in that during the manufacture of the closure unit and in a further stage, one or more coatings are applied to the inside, to the outside or to both the inside and outside of the closure unit. These coatings adhere to the pouring part and to the closure part and consequently bridge a gap between the pouring part and the closure part in the form of a thin membrane or at least partly fill the same. At the time of the initial opening of the closure part the coating is only interrupted at this comparatively very small gap and cannot be restored again following closing. As a result of a planned design of the closure unit at said gap or separation point, it can be ensured that in spite of this it is possible to substantially maintain the requisite characteristics such as e.g. a gas and/or radiation seal.

The advantages resulting from the invention are in particular that the demands made on the container for the protection of the product are still maintained if further functions are to be performed with the container. In other words, if with respect to the product which it is to contain, the container has to perform several functions such as e.g. protecting the product against external influences, product handling, product storage, etc., one of these functions is not impaired if or because another of the intended functions is fulfilled. Therefore each function is independently maintained compared with the other functions or characteristics. This is not the case in the known containers, where the performing of one function necessarily impairs the other functions. For example, a handling of the product, such as its partial removal from the known container, then impairs the container protection function. In the case of the container with the closure unit according to the invention, this is not the case. An important advantage of the solution according to the invention is that the application of the coatings can be integrated into the manufacturing process for the closure unit. Thus, it is possible to manufacture a finished closure unit having all the desired properties and this can be subsequently fitted to a container. The invention also makes it possible to adapt the characteristics of the container and closure unit together to the most varied conditions. Thus, it is possible to provide a first coating, which fulfils in optimum manner a first condition (e.g. light seal or oxygen exchange barrier). However, if this coating can be mechanically damaged, e.g. by granular material in the container, then a further coating can be provided, which protects the first coating against mechanical damage. A third coating can be provided, which has further supplementary properties, etc. Therefore the individual coatings are allocated characteristics or functions, which they fulfil in an optimum manner and the missing properties can be supplemented by additional coatings, which in turn fulfil in optimum manner said supplementary properties. Thus, it is possible to fulfil in an optimum manner a large number of conditions applied to the container and closure unit. The reduced properties with respect to the gap between the pouring part and the closure part can, as stated, at least partly be compensated by other measures. Even if this is not always possible, then the surface parts which do not completely fulfil said characteristics, are negligibly small with respect to the inner face of the container.

BRIEF DESCRIPTION OF THE DRAWINGS

The invention is described in greater detail hereinafter relative to the drawings, wherein.

DESCRIPTION OF THE PREFERRED EMBODIMENTS

Figure 1:
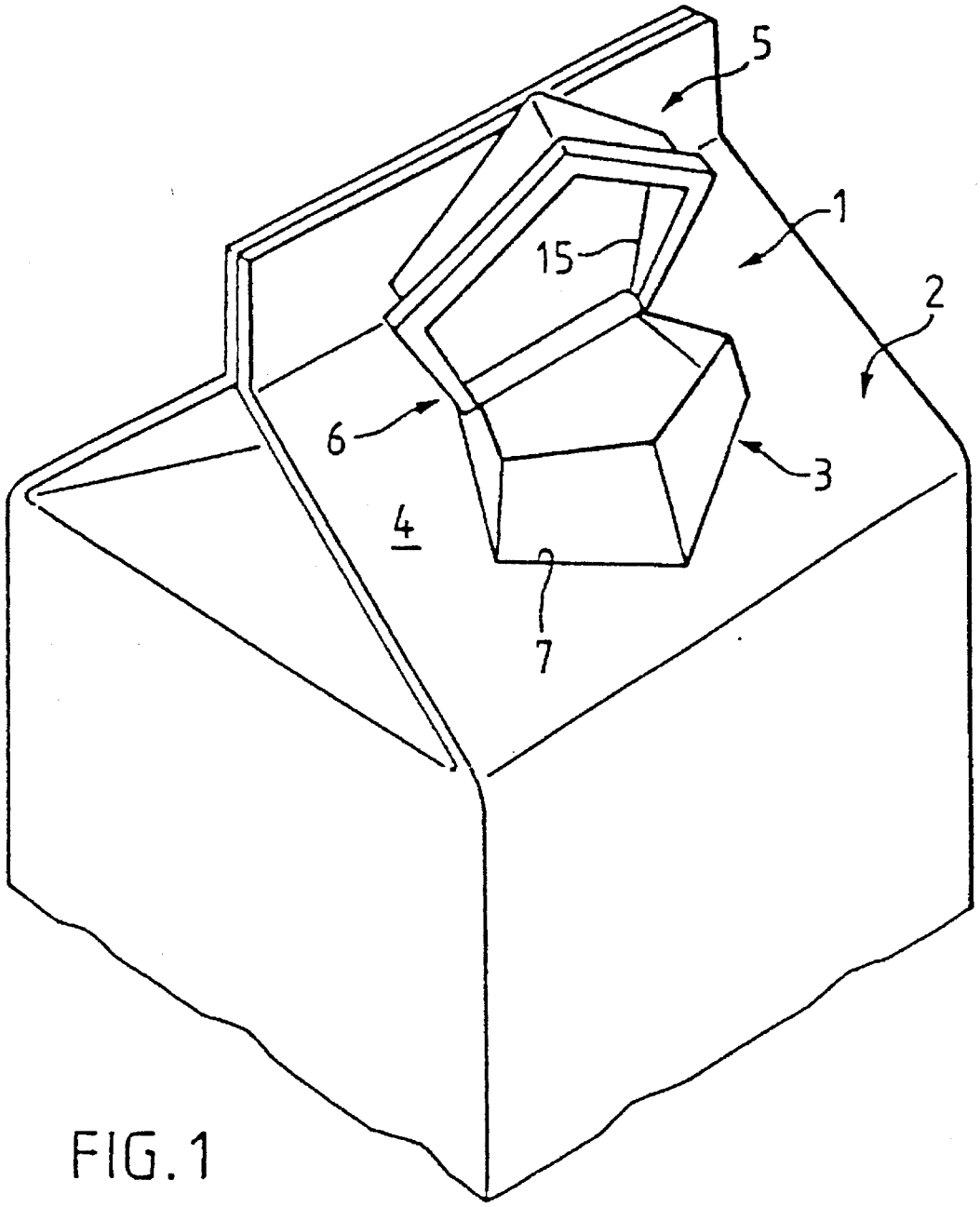
FIG. 1 is a perspective view of a closure unit in accordance with the invention which has been mounted on a container.

FIG. 1 shows a closure unit 1, which is placed in a cardboard container 2. The closure unit 1 comprises a pouring part 3, which projects from one face 4 of the container 2 and also a closure part 5, which is shown here in the open state. The closure part 5 and the pouring part 3 are non-detachably interconnected by means of a hinge 6. The face 4 of the container has an opening 7 in which is inserted the closure unit 1 and in the presently illustrated example the closure unit must be pushed through the opening 7 from the container interior before being fixed to the wall 4, e.g. by ultrasonic welding.

Figure 2:
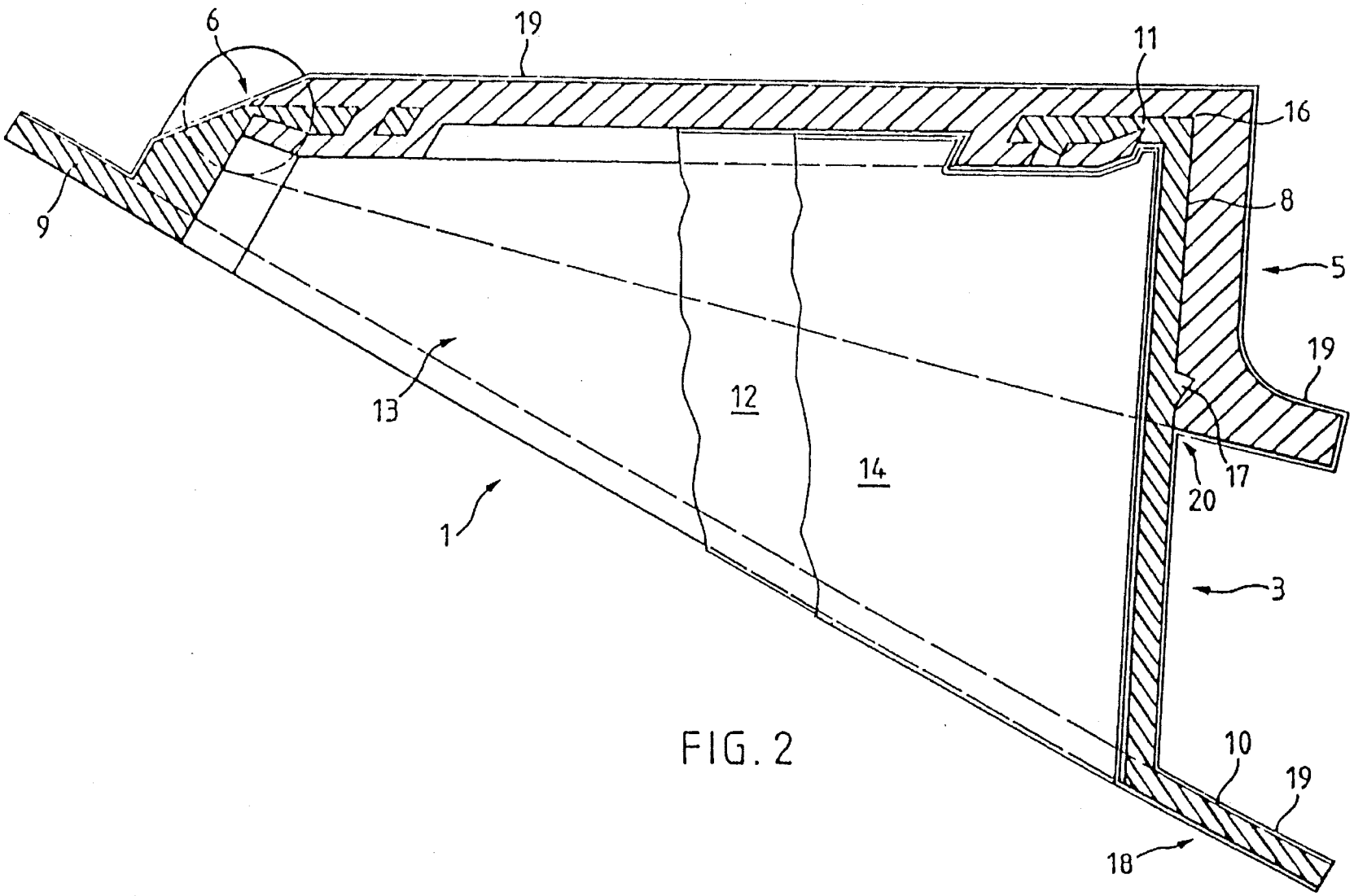
FIG. 2 is a side elevation, in section, of a closure unit in accordance with the invention apart from a container.

FIG. 2 shows a section through the closure unit 1 of FIG. 1, where it is possible to see the pouring part 3, the closure part 5 and a hinge 6. The construction shown has various additional details, which are not essential to the invention, but which are represented in order to show a completely functioning closure unit. Such a detail is e.g. a predetermined breaking point 11, which is destroyed on the initial opening and forms the actual gap or separating point between the pouring part 3 and the closure part 5. The closure unit also has sealing faces 8, which are located between the pouring part 3 and the closure part 5, where said two parts cover one another. It is also possible to see a foot 9, which is fixed to the pouring part 3 and which forms a face 10 by means of which the closure unit 1 can be fixed in the wall 4 (FIG. 1). Bonding, adhesion or welding can be used for fixing purposes. It is also possible to see a first coating 12, which is here only applied to the inside 13 of the right-hand half of the closure unit and which is covered by a further coating 14. It is also possible to see an external coating 19, which here extends both over the closure part 5 and the pouring part 3.

On the initial opening of the closure part 5, the coating 12,14 is destroyed in the vicinity of the predetermined breaking point 11 and which in FIG. 1 roughly follows the line 15. However, the outer coating 19 is torn or interrupted in the vicinity of a point 20. The exemplified construction of the closure unit 1 shown ensures that the action of this destruction remains extremely small, because the closure unit 5 so closely surrounds the pouring part 3 in the vicinity of the sealing faces 8, that, even without a coating, the closure unit 1 is tight with respect to the passage of gas or liquid. This is assisted by further baffles, designated 16 and 17 and which form additional corners and faces, which e.g. improve the sealing action. If the coating 12,14 of the closure unit 1 is to be improved with respect to the diffusion of gas or liquid through its walls, said action is maintained by the intact coating 12,14 over the entire remaining inner face 13. In the vicinity of the predetermined breaking point 11 the material thickness is at least doubled, so that the diffusion is also significantly inhibited by the increased material thickness at the point where the coating is damaged. The same action is also obtained in the vicinity of the separation point 11 with respect to radiation, diffusion, etc. If the coatings are in particular provided for stopping the diffusion of gases or the passage of rays, then an inner and outer coating is particularly effective, because both act in large-area form and do not have their separation point 11,20 at the same location, so that one coating covers the separation point of the other coating.

Such a closure unit 1 is fixed by means of the foot 9 to the container 2. If this takes place by welding, then in an area 18 it is necessary to weld through the coating, which can consequently be destroyed at this point. However, in the said area 18 the material from which the foot 9 and the wall 4 is formed is modified, e.g. compacted by the welding process, so that this effect compensates the lost action of the coating. If this is not the case, it is e.g. possible to use adhesion, so, that the coating remains intact. Welding interrupts the coating, whereas adhesion or bonding bridges the coating.

The coatings 12 can be made from the most varied materials and those made from mineral substances are particularly favourable. This leads to a glassy coating, which is chemically neutral and can therefore come into contact with the most varied materials without reacting. Glassy coatings are also very suitable for preventing an undesired gas exchange. To protect the product against the influence of radiation or electric and magnetic fields, coatings made from metallic materials are very suitable. As a further coating 14 can be provided plastic coatings, which e.g. offer protection to thermal and mechanical influences. Thus, it is possible to supplement the characteristics of the metal coating, which are relatively damage-prone, in that they are given the necessary damage protection.

The coatings can be provided internally on the closure unit, i.e. on the inner face 13, as well as on the outer face or on both faces. The coatings have a thickness extending from a few Angström to a few tenths of a mm, as a function of the coating type and the task which it has to fulfil.

In the case of the process of the invention for the production of the closure unit firstly the closure unit 1 is produced e.g. by moulding in per se known manner. Subsequently the closure unit is provided with a first coating in a further, per se known device and this preferably takes place with the closure part closed. Then in the same or a different device a further coating is applied. The devices used depend on the nature and material of the coating. If e.g. an aluminium coating is provided, then this takes place in a device for the vacuum deposition of aluminium. Coatings based on silicone oxides, which are relatively hard, can be produced by application in a plasma. This is very advantageous, because the process need not take place at high temperatures. Plastic coatings can be sprayed on.

As the coatings can be of the most varied types and as the production or application of the coating is greatly dependent on the coating type, the possibilities available have not been exhaustively discussed, but are covered by the scope of the invention.

We claim:

1. A closure unit made from thermoplastic material for subsequent attachment to a container (1) for the handling and storage of a flowable product comprising a substantially tubular pouring part (3) having a wall defining an opening;

an openable and reclosable closure part (5) closing said opening of said pouring part, and at least a first coating (12) extending continuously over both an inner surface of said openable and reclosable closure part and an interior surface of said wall defining said opening of said pouring part, said first coating protects the product against undesired influences.

2. A closure unit according to claim 1 further comprising a second coating (14) covering said first coating (12).

3. A closure unit according to claim 1 wherein said first coating comprises a mineral material.

4. A closure unit according to claim 1 wherein said first coating comprises a metallic material

5. A closure unit according to claim 2 wherein said second coating comprises plastic.

6. A closure unit according to claim 1 having a separating line (11) between said pouring part and said closure part, and wherein said coating bridges said separating line.

7. A closure unit according to claim 6 wherein said first coating has an increase in thickness in the portion of said first coating bridging said separating line (11).

8. A closure unit according to claim 6 wherein said pouring part and said closure part include sealing faces adjacent said separating line (11).

9. A closure unit according to claim 2 wherein said first coating (12) and said second coating (14) have mutually supplementing characteristics.

10. A closure unit according to claim 1 and further comprising an additional coating on outside surfaces of said pouring part and closure part.

* * * * *